US011022116B2

(12) United States Patent
Kim et al.

(10) Patent No.: US 11,022,116 B2
(45) Date of Patent: Jun. 1, 2021

(54) LUBRICANT SUPPLY DEVICE AND A COMPRESSOR USING THE SAME

(71) Applicant: LG Electronics Inc., Seoul (KR)

(72) Inventors: Young Hwan Kim, Seoul (KR); Seungwook Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 212 days.

(21) Appl. No.: 16/252,299

(22) Filed: Jan. 18, 2019

(65) Prior Publication Data

US 2019/0226481 A1 Jul. 25, 2019

(30) Foreign Application Priority Data

Jan. 19, 2018 (KR) ..... 10-2018-0007370

(51) Int. Cl.
*F03C 2/00* (2006.01)
*F03C 4/00* (2006.01)
(Continued)

(52) U.S. Cl.
CPC ..... *F04C 15/0088* (2013.01); *F04B 27/109* (2013.01); *F04B 39/02* (2013.01);
(Continued)

(58) Field of Classification Search
CPC ..... F04C 15/0088; F04C 15/06; F04C 2/10; F04C 2/102; F04C 29/02; F04C 29/023;
(Continued)

(56) References Cited

U.S. PATENT DOCUMENTS 3,165,066 A * 1/1965 Phelps ..... F04C 2/102 418/171
3,343,494 A * 9/1967 Erikson ..... F04C 2/102 418/171
(Continued)

FOREIGN PATENT DOCUMENTS

EP 1023537 8/2000
KR 100195944 6/1996
(Continued)

OTHER PUBLICATIONS

Extended European Search Report in European Application No. 19152505.4, dated Mar. 28, 2019, 5 pages.

*Primary Examiner* — Theresa Trieu
(74) *Attorney, Agent, or Firm* — Fish & Richardson P.C.

(57) ABSTRACT

Disclosed is a trochoid lubricant supply device that is configured to connect to a rotational shaft. A connector of the lubricant supply device is configured to reduce an oil leakage amount of lubricant, and is configured to insert to a lower portion of a rotational shaft. The connector includes: a rotator mounting member inserted into and fixed to the rotator of the lubricant supply device; a penetrating member that penetrates a fixer of the lubricant supply device; an enlarged diameter extending radially outwards from the penetrating member outside the fixer; and a rotational shaft mounting member extending axially in the diameter enlarged member and is fastened to the rotational shaft. Further, the lubricant supply device of the present disclosure can supply the oil regardless of a rotation direction of the rotational shaft by supplying the oil by a space pivoting about the rotational center of the rotator.

20 Claims, 11 Drawing Sheets

(51) Int. Cl.

| | |
|---|---|
| ***F04C 15/00*** | (2006.01) |
| ***F04C 2/00*** | (2006.01) |
| ***F04C 2/10*** | (2006.01) |
| ***F04C 15/06*** | (2006.01) |
| ***F04B 39/02*** | (2006.01) |
| ***F04B 27/10*** | (2006.01) |
| ***F04B 39/16*** | (2006.01) |

(52) U.S. Cl.
CPC ..... *F04B 39/0246* (2013.01); *F04B 39/16* (2013.01); *F04C 2/10* (2013.01); *F04C 15/06* (2013.01); *F04C 2210/14* (2013.01); *F04C 2240/603* (2013.01)

(58) Field of Classification Search
CPC .... F04C 29/025; F04C 14/04; F04C 2210/14; F04C 2240/603; F04B 35/04; F04B 39/02; F04B 39/023; F04B 39/0238; F04B 39/0246; F04B 39/0261; F04B 39/0276; F04B 39/16; F04B 27/109
See application file for complete search history.

(56) References Cited

U.S. PATENT DOCUMENTS

| | | | | |
|---|---|---|---|---|
| 3,456,874 | A * | 7/1969 | Graper | F04B 27/005 417/534 |
| 5,017,108 | A * | 5/1991 | Murayama | F04C 29/025 184/6.18 |
| 2002/0170779 | A1 | 11/2002 | Kim | |
| 2002/0172607 | A1* | 11/2002 | Kim | F04B 39/0246 417/363 |
| 2007/0071627 | A1* | 3/2007 | Lee | F04C 29/025 418/88 |
| 2007/0134118 | A1* | 6/2007 | Yoo | F04C 29/025 418/88 |
| 2010/0122549 | A1* | 5/2010 | Cho | F04C 29/025 418/88 |

FOREIGN PATENT DOCUMENTS

| | | |
|---|---|---|
| KR | 1020030010963 | 2/2003 |
| KR | 1020150075445 | 7/2015 |
| KR | 1020160127361 | 11/2016 |
| WO | WO0001949 | 1/2000 |
| WO | WO2009132975 | 11/2009 |

* cited by examiner

LUBRICANT SUPPLY DEVICE AND A COMPRESSOR USING THE SAME

CROSS-REFERENCE TO RELATED APPLICATION

The present application claims priority to and the benefit of Korean Patent Application No. 10-2018-0007370, filed on Jan. 19, 2018, the disclosure of which is incorporated herein by reference in its entirety.

FIELD

The present disclosure relates to a lubricant supply device used for a compressor or the like.

BACKGROUND

A compressor is a device that increases pressure by compressing gas. In a method in which the compressor compresses the gas, there are a reciprocating compression method that compresses and discharges gas suctioned into a cylinder by a piston and a scroll compression method that compresses gas by relatively rotating two scrolls, etc.

The compressor is provided with a rotational shaft that provides force that compresses the gas. Since the compressor is provided with a large number of mechanical elements that mutual friction occurs, lubrication therefor is required.

Hereinafter, the related art of the present disclosure will be described with reference to FIGS. 1 to 4.

Referring to FIG. 1, a reciprocating compressor has a structure in which a frame 20 is accommodated inside a housing 10. The frame 20 supports a rotational shaft 50. A lubricant supply flow path 53 is provided inside the rotational shaft 50 and a lubricant supplier 60 is installed at a lower end of the rotational shaft 50. Lubricant is stored in a lower portion of an inner space of the housing 10, and a lower end of the lubricant supplier 60 is submerged in the lubricant.

The lubricant supplier 60 includes a rotator 62 that rotates with the rotational shaft 50 and a fixer 61 that is fixed to the frame 20 and does not rotate. The rotator 62 is accommodated inside the fixer 61.

The fixer 61 is installed in a state of being connected to a frame 20 by a fixed connection member 619, and even if the rotational shaft 50 rotates, the fixer 61 does not rotate with the rotational shaft 50 and maintains a state of being fixed to the frame 20.

The rotator 62 includes a first rotator 621 that penetrates a cover of the fixer 61 and is accommodated in a space inside the fixer 61, and a second rotator 622 that surrounds an outer circumferential surface of the rotator 621 in the fixer 61 and is accommodated in the accommodation space 615 of the fixer 61. A shaft coupler 626 which is press-fitted to an inner circumferential surface of a lubricant supply flow path 53 formed through the longitudinal direction of a rotational shaft 50 is formed integrally at an upper portion of the first rotator 621. A part of the first rotator 621 is tooth-engaged with a part of the second rotator 622 and a predetermined rotator space 625 is provided where they are not tooth-engaged therebetween.

As the rotational shaft 50 rotates, the first rotator 621 whose shaft coupler 626 is press-fitted to the lubricant supply flow path 53 of the rotational shaft 50 rotates and the second rotator 622 also rotates. Then, oil flowed in the fixer through an oil inlet 617 of the fixer 61 moves to an oil chamber 618 while being trapped in a rotator space 625. The volume of the rotator space 625 existing in adjacent to the oil inlet 617 gradually decreases as the rotator 62 rotates and moves to the direction of the oil chamber 618. Thus, the oil filled in the rotator space 625 is pressurized and pushed into the oil chamber 618 of the fixer 61 and the oil pushed into the oil chamber 618 is pumped upward again through an oil outlet 629 of the rotator 62.

Meanwhile, according to a structure of such a lubricant supply device, as shown in FIGS. 3 and 4, the distance d1 between a rotator space 625 and a through-hole 616 of a cover 612 is very narrow. Thus, a phenomenon in which oil pressurized in the rotator space 625 leaks out through a gap between an outer circumferential surface of an oil outlet 629 and a through-hole 616 via a gap between an upper surface of a first rotator 621 and a cover 612 occurs.

In addition, in the lubricant supply device, the distance d2 between an oil outlet 629 and an oil inlet 617 is also very narrow. Thus, a phenomenon in which high pressure oil that flows through the oil outlet 629 also leaks again adjacent to the oil inlet 617 through a gap between a lower surface of the first rotator 621 and the bottom 614 of a body 611 occurs.

In order to secure a wide distance d1 between a through-hole 616 of the cover 612 and a rotator space 625 to prevent the oil leakage phenomenon as described above, the diameter of a shaft coupler 626 and the diameter of the through-hole 616 of an outer diameter cover 612 can be reduced or the outer diameter of the first rotator 621 can be increased. Further, in order to secure the wide distance d2 between the oil outlet 629 and the oil inlet 617, the outer diameter of the shaft coupler 626 can be reduced or the outer diameter of the first rotator 621 can be increased.

However, since a rotational shaft 50 is a part in which the diameter in certain degree has to be secured, there is a limitation to reduce the outer diameter of a shaft coupler 626. Further, when increasing the outer diameter of the first rotator 621, the diameters of a second rotator 622 and a fixer 61 have to be significantly increased accordingly. This result in decreasing an efficiency of the compressor since more power for a rotating the rotational shaft for compressing a refrigerant is consumed as power for supplying lubricant.

Thus, the above mentioned method for preventing oil leakage of oil results in a yet another side effect.

Meanwhile, in the oil pump structure described above, even if the first rotator 621 and the second rotator 622 rotate, the rotator space 625 does not deviate at the position shown if FIG. 4. Therefore, when the rotator space 625 moves clockwise from the left to the right, the volume thereof gradually decreases. And when the rotator space 625 moves clockwise from the right to the left, the volume thereof increases. According to this method, oil in the rotator space 625 in the wide volume can be pumped by the gradually narrowing volume only when the rotation direction of a rotational shaft is clockwise. That is, when the rotational shaft rotates in the opposite direction due to a cause for connecting the power source for a motor that rotates the rotational shaft to the opposite polarity, etc., the oil pump structure cannot supply the oil.

The reciprocating compressor is advantageous in that a compressor operates regardless of the rotation direction of the rotational shaft. However, when the structure in which the oil is supplied only when it is rotated in any one direction as described above is applied to the reciprocating compressor, the above described advantage of the reciprocating compressor cannot be exhibited.

On the other hand, in the reciprocating compressor, in order to increase an efficiency of the compressor, the rotational shaft may be designed to be capable of operation in bi-directions. For example, a design in a manner that efficiency is high at the time of high-speed operation when rotating in a first direction and at the time of low-speed operation when rotating in a second direction which is an opposite direction of the first direction is occasionally required. However, the oil pump structure of FIGS. 1 to 4 described above cannot be applied to the rotational shaft of the compressor designed to be bi-directionally rotatable. Therefore, when the compressor capable of the bi-directional rotation is designed as described above, even if it rotates in any direction, the pump structure capable of supplying oil is required.

SUMMARY

The present disclosure has been devised to solve the above-mentioned problems. It is an object of the present disclosure to provide a lubricant supply device that can prevent oil from leaking without reducing the diameter of a rotational shaft or enlarging the diameter of a lubricant supply device.

Further, it is an object of the present disclosure to provide a lubricant supply device capable of supplying oil regardless of the rotation direction, and a compressor applying such lubricant supply device.

Further, it is an object of the present disclosure to provide a lubricant supply device in which a slip does not occur when rotational force of the rotational shaft is transmitted to the lubricant supply device.

In order to solve the above described problems, in the present disclosure, there is provided a lubricant supply device 60. The lubricant supply device 60 is installed at one end of a rotational shaft 50 provided with a hollow lubricant supply flow path 53 formed along the longitudinal direction and supplies lubricant to the lubricant supply flow path 53 and is compact, and does not occur an oil leakage phenomenon.

The lubricant supply device 60 includes: a fixer 61 that is provided with an oil inlet 617, an accommodation space 615 that communicates with the oil inlet 617, and an oil chamber 618 that is not directly communicated with the oil inlet 617 and communicates with the oil inlet 617 via the accommodation space; and a rotator 62 that is accommodated in the accommodation space 615 of the fixer 61 and is coupled to the rotational shaft 50 to rotate with the rotational shaft.

The oil inlet 617 may be opened downward, and the accommodation space and the oil inlet of the fixer may be installed in a state of being submerged in oil stored inside a housing of the compressor.

The fixer 61 includes a second fixer 612 that is provided with a through-hole 616 at the center thereof and covers an upper portion of the accommodation space.

The rotator 62 includes: a rotator space 625 that is provided at a position radially spaced apart from the rotational center of the rotator, and at least a part thereof faces the oil inlet 617 and the other part thereof faces the oil chamber 618; an inner diameter coupler 627 provided at the rotational center of the rotator; and a connector 63 that connects the inner diameter coupler 627 and the rotational shaft 50 and is provided with an oil outlet 639 connected to the oil chamber 618 and the lubricant supply flow path 53.

The rotator 62 may be a form in which various parts are assembled. That is, the rotator may be a form in which the parts made of the connector and the part other than the connector are assembled and coupled. In more detail, the part other than the connector of the rotator may be a form in which two or more sub-parts are made and assembled.

The connector 63 includes: a rotator mounting member 632 that is inserted into and fixed to the inner diameter coupler 627; a penetrating member 635 that extends axially from the rotator mounting member 632 and penetrates the through-hole 616; a diameter extended member 633 extending radially outward from the penetrating member 635 at the upper portion of the second fixer 612; and a rotational shaft mounting member 631 that extends axially from the diameter enlarged member 633 and is mounted to the rotational shaft 50.

The diameter of the penetrating member that penetrates a through-hole can be made smaller than the diameter of the rotator coupled to the rotational shaft by adding an enlarged diameter structure to the connector when separately making the connector. Accordingly, even if the diameter of the lubricant supply device is not increased, it is possible to make the length of the path longer, through which oil in the rotator space 625 can leak, thereby minimizing oil leakage of oil.

The cross sectional area inside the inner diameter coupler 627 is included in the cross sectional area inside the penetrating member 635, or the inner diameter of the inner diameter coupler 627 is equal to or smaller than an outer diameter of the penetrating member 635, and the outer diameter of the penetrating member 635 is smaller than the outer diameter of the rotational shaft mounting member 631 so that it is possible to prevent the oil leakage while making an assembly of the lubricant supply device convenient.

As the rotator 62 rotates, the oil flowed in the rotator space 625 through the oil inlet 617 is supplied to the oil chamber 618, and the oil in the oil chamber 618 is supplied to the lubricant supply flow path 53 through the oil outlet 639.

The connector 63 is made as a separate part so that the one end of the rotational shaft 50 is inserted into a shaft coupling space 637 defined by the inner diameter of the rotational shaft mounting member 631 and there is no need to increase the diameter of the first rotator 621. In particular, this can further reduce a press-fit tolerance between the rotational shaft mounting member 631 and the outer circumferential surface 58 of the rotational shaft 50, as compared with a structure in which a shaft coupler 626 is fitted in the inner circumferential surface of the rotational shaft 50.

Further, since a processing of an outer circumferential surface 58 of the rotational shaft 50 is easier than that of an inner circumferential surface of the rotational shaft, by applying an insertion structure, it is possible to provide a first idling preventing surface (e.g., a shaft contact surface) 54 on the outer circumferential surface 58 of the one end of the rotational shaft 50 and it is possible to provide a second idling preventing surface 634 that contacts with the first idling preventing surface 54 on an inner circumferential surface 6371 of a rotational shaft mounting member 631.

Further, a third idling preventing surface 628 may be provided on the inner circumferential surface 6271 of the inner diameter coupler 627 and a fourth idling preventing surface 636 that contacts with the third idling preventing surface 628 may be provided on the outer circumferential surface of the rotator mounting member 632.

The fixer 61 may further include a first fixer 611 that is provided with the oil inlet 617, the accommodation space, and the oil chamber 618 and accommodates the rotator 62, and the second fixer 612 may cover the accommodation space in a state where the rotator 62 is accommodated in the accommodation space of the first fixer 611. Such a fixer structure is highly convenient for assembly.

The rotator 62 may further include a first rotator 621 that the inner diameter coupler 627 is provided at the center thereof and includes a first tooth 623 formed radially outwards about the center of the inner diameter coupler 627, and a second rotator 622 that is provided with a second tooth 624 formed inwards while surrounding the first tooth 623 and is accommodated in the accommodation space, and the part of the first tooth 623 and the part of the second tooth 624 are mutually engaged and the space between the first tooth 623 and the second tooth 624 may define the rotator space 625. This not only makes a pumping structure of the lubricant, but also provides the basis that can supply the lubricant for a bi-directional rotation.

Particularly, the rotational center O1 of the first rotator 621 may coincide with the rotational center O2 of the second rotator 622 and the center C2 of the second tooth 624 may be disposed eccentrically from the rotational center O1 so as to make the lubricant supply device capable of being operated in the bi-directional rotation.

A profile of a tooth the first tooth 623 and a profile of a tooth of the second tooth 624 may include complementary shapes so as to be engaged with each other, and the number of teeth of the second tooth 624 is larger than the number of teeth of the first tooth 623 so that a rotator space 625 can be made due to the difference in the circumferential distance of a tooth.

The radius b of a groove of the first tooth 623 may be smaller than the radius d of a protrusion of the second tooth 624 and the radius a of a protrusion of the first tooth 623 a may be larger than the radius d of the protrusion of the second tooth 624 and smaller than the radius c of a groove.

The distance in which the center C2 of the second tooth 624 is eccentric from the rotational center O1 may be equal to or smaller than the difference between the radius c of a groove of the second tooth 624 and the radius a of the protrusion of the first tooth 623.

Further, in the present disclosure, there is provided a compressor. The compressor includes: the lubricant supply device 60; a rotational shaft 50 installed with the lubricant supply device 60 at one end thereof; a frame 20 that includes a rotation supporter 25 that supports a rotation of the rotational shaft 50; the motor 21 and 52 that is provided on the rotational shaft 50 and the frame 20 and rotates the rotational shaft 50 in a first direction with regard to the frame 20 and rotates the rotational shaft 50 also in a second direction which is an opposite direction of the first direction; and a housing 10 that lubricant is stored in a lower portion and the frame 20 is accommodated in an upper portion of a lubricant storage space.

According to the lubricant supply device of the present disclosure, it is possible to prevent oil from leaking without reducing the diameter of the rotational shaft or increasing the diameter of the lubricant supply device.

Further, the lubricant supply device of the present disclosure can utilize the compressor capable of the bi-directional rotation because an oil supply using the rotational force of the rotational shaft is possible regardless of the rotation direction of the rotational shaft. Thus, it is possible to differently design an efficiency of the motor according to the rotation direction, so that a high efficiency compressor design is possible.

Specific effects of the present disclosure, with the above described effect, will be described in conjunction with the described specific details for implementing the present disclosure below.

DETAILED DESCRIPTION

Hereinafter, exemplary implementations of the present disclosure will be described in detail with reference to the accompanying drawings.

The present disclosure is not limited to the implementation disclosed below and may be implemented in various manners different from each other, and the implementations are provided so that this disclosure of the present disclosure will be thorough and complete, and will fully convey the scope of the disclosure to those skilled in the art.

Figure 5:
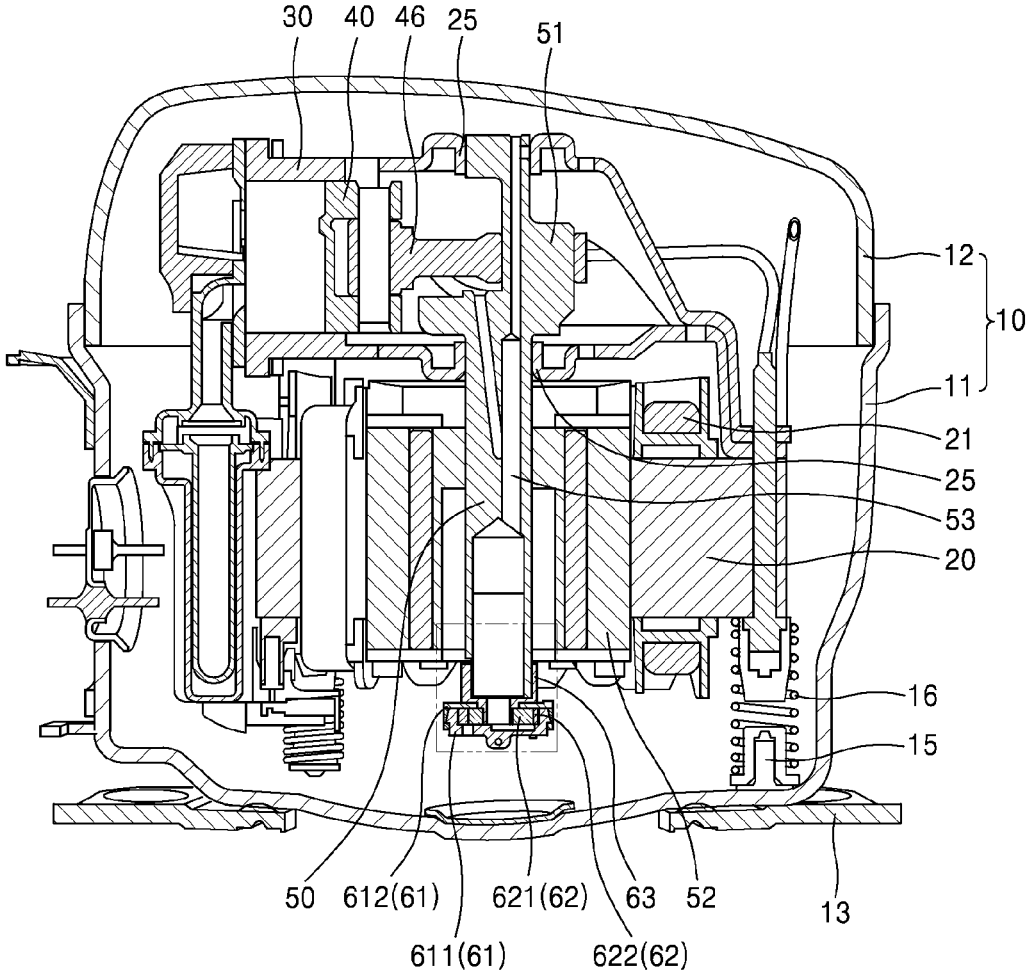
FIG. 5 is a side cross sectional view of a reciprocating compressor in which a lubricant supply device is installed according to an exemplary implementation of the present disclosure.

Referring to FIG. 5, a structure of a compressor to which a lubricant supply device of the present disclosure is applied is described. A compressor 1 exemplified in the present disclosure is a reciprocating compressor.

Each component of the compressor 1 is installed inside a housing 10. The housing 10 includes a main housing 11 in the form of a deep container and a cover housing 12 that covers and seals an upper portion of the main housing 11. A leg 13 is provided at the bottom of the main housing 11. The leg 13 is configured to fix the compressor 1 to an installation position.

In the inner space of the housing 10, a boss 15 is provided at the bottom. The boss 15 fixes an elastic body 16 such as a coil spring. A frame 20 is fixed to an upper portion of the elastic body 16. The elastic body 16 fixes the frame 20 to the housing 10 while the housing 10 and the frame 20 are not directly connected. Therefore, a vibration of the frame 20 is prevented from being transmitted to the housing by the elastic body 16.

A rotation supporter 25 of the frame 20 supports a rotation of a rotational shaft 50 and the rotational shaft 50 extends in the vertical direction and the rotation is supported at two points by a frame. The rotational shaft 50 of the compressor is supported at two points located at an upper portion and a lower portion of a crank pin respectively.

The rotational shaft 50 rotates by a motor, and the motor is controlled by an inverter. A stator 21 is fixed to the frame 20 and a rotor 52 is fixed to the rotator shaft 50 and the rotor shaft 50 rotates by inverter control.

The crank pin 51 is provided at the upper portion of the rotational shaft 50. The crank pin 51 is parallel to the rotational shaft, and is disposed eccentrically from the center of the rotational shaft.

A cylinder 30 extending in the horizontal direction is provided at the same height in which the crank pin 51 is provided. The cylinder 30 of the compressor may be made as a separate part from the rotation supporter 25 and assembled.

The piston 40 may do a reciprocating motion along the longitudinal direction of a cylinder 30 regardless of the rotation direction of the rotational shaft.

A lubricant supplier 60 is installed at a lower portion of the rotational shaft 50. Lubricant is stored in the lower portion of the inner space of the housing 10. The lubricant supplier 60 is submerged in the lubricant. The lubricant supplier 60 is provided with a fixer 61 fixed to a frame 20 and a rotator 62 that rotates with a rotational shaft 50. A relative rotation of the rotator 62 with regard to the fixer 61 pumps the lubricant upward.

The rotational shaft 50 is provided with a hollow lubricant supply flow path 53. The lubricant supply flow path 53 extends from a lower end of a rotational shaft to a position near the position where lubrication is required. For example, oil (lubricant) may be supplied to a friction section of a cylinder 30 and a piston 40, a connecting portion of a crank pin 51 and a connecting rod 46, and a connecting portion of a connecting rod 46 and a piston 40, and a supporting portion of a rotational shaft 50.

The lubricant supplied to where it is needed flows down or falls back to the bottom of the housing 10 by gravity after wetting the corresponding portion.

Hereinafter, an implementation of a lubricant supply apparatus according to the present disclosure will be described with reference to FIGS. 5 to 10.

A lubricant supply device 60 includes a fixer 61 that maintains a state fixed to a frame 20 and a rotator 62 that is fixed to a lower end of a rotational shaft 50 of a compressor 1 and rotates with a rotator 62.

A fixer 61 is fixed to a frame 20 of a lubricant supply device 60 through a fixed connecting member 619. The fixer 61 remains a fixed state with a frame even if a rotational shaft 50 rotates. The fixer 61 supports a rotation of the rotator 62 and maintains a fixed state.

The fixer 61 includes a body portion that forms a body, that is, a first fixer 611 and a cover portion that covers an upper part of the body, that is, a second fixer 612.

An accommodation space 615 that accommodates a rotator 62 is provided on an upper portion of the first fixer 611. The accommodation space is a space defined by a side wall 613 and the bottom 614 of a first fixer 611 and is a substantially cylindrical space having small height and widely flattened. The upper portion of the accommodation space 615 is open and the lower end of a lowest portion thereof is defined by the bottom 614 of the first fixer 611. The upper portion of the accommodation space 615 is covered by a second fixer 612.

The second fixer 612 is coupled to the first fixer 611 in a form of covering and surrounding the upper portion of the accommodation space 615 and the outer circumferential surface of the side wall 613. As a specific method of coupling the first fixer 611 and the second fixer 612, a ring-shaped first mounting member 64 that has a fitting hole opened laterally is provided on the side of the second fixer 612, and a second mounting member 65 in the form of an engaging hook capable of being fitted to the fitting hole is provided on the side of the first fixer 611. The second mounting member 65 has a shape gradually protruding as it is closer downward. A first mounting member 64 extends further downward than a side wall of the first fixer 611, so that it is easily deformed. The first mounting member 64 is elastically deformed in contact with the upper portion of the second mounting member 65. When the second mounting member 64 contacts with a hole of the first mounting member 64, the first mounting member may be elastically deformed and a ring-shaped lower end of the first mounting member 64 is engaged with a lower portion of the second mounting member.

A circular through-hole 616 is provided at the center of the second fixer 612. A connector 63 of a rotator 62 to be described later penetrates through the through-hole 616.

The bottom 614 is provided with the oil inlet 617 that penetrates vertically in order to communicate an outer space in the lower portion of the first fixer 611 with the accommodation space 615 and an oil chamber 618 formed as a part of the surface facing the accommodation space 615 is depressed at a position that is not overlapped with a position where the oil inlet 617 is formed.

The oil inlet 617 is a form that penetrates the bottom 614 vertically. Therefore, through the oil inlet 617, the accommodation space 615 and the space in the lower portion of the bottom 614 of the first fixer 611 are connected to each other.

Figure 6:
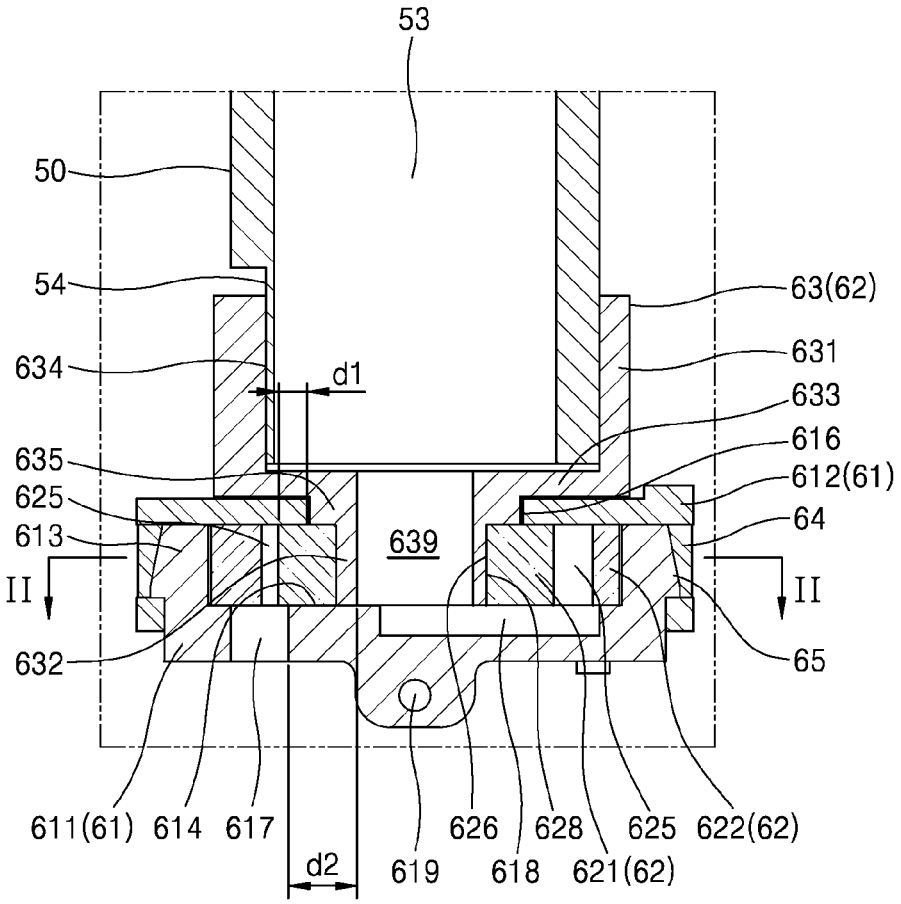
FIG. 6 is an enlarged view of a portion of FIG. 5.
Figure 7:
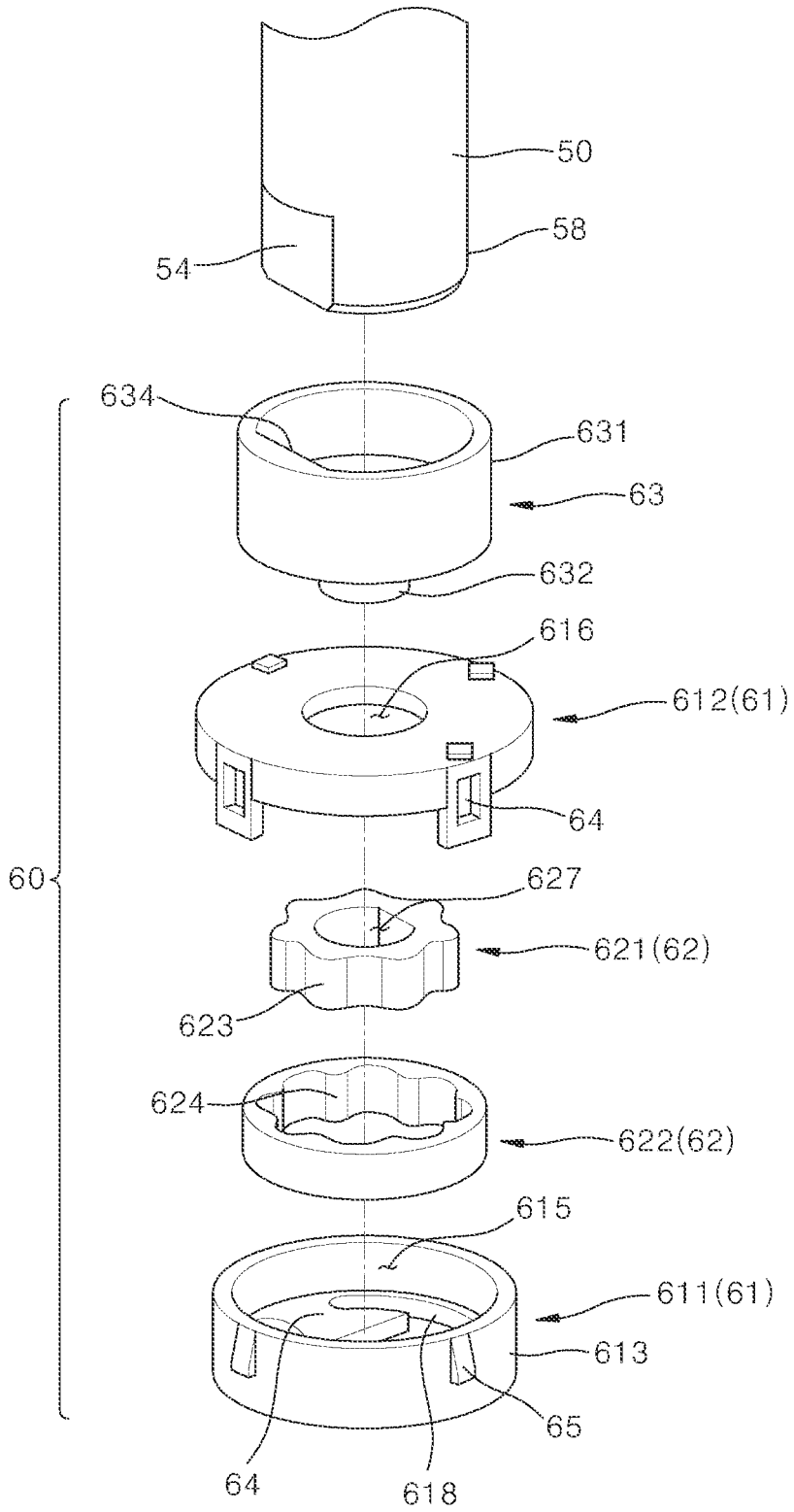
FIG. 7 is an exploded perspective view of a lubricant supply device of FIGS. 5 and 6.

The first distance to the position in which the oil inlet 617 is formed from the center of the bottom 614 to the radial direction is the same as the second distance to the position in which the oil chamber 618 is formed from the center of the bottom 614 to the radial direction. The oil chamber 618 has a form extending radially to the center of the bottom 614. The first fixer 611 is almost submerged in oil. For reference, line II-II of FIGS. 5 and 6 is a reference line that shows a cross section of FIGS. 10 and 11 and indicates oil level of lubricant stored in the bottom of a housing 10 approximately. Therefore, the lubricant stored in the housing can be flowed in the accommodation space 615 through the oil inlet 617.

The oil chamber 618 is a groove formed in an upper surface of the bottom. That is, the oil chamber 618 is a space that is depressed more than an upper surface of the bottom 614. The bottom surface of the oil chamber 618 is closed 7. Thus, even if the first fixer 611 is submerged in oil as FIG. 7, the oil outside the first fixer 611 can be flowed in the oil chamber 618 only through the oil inlet 617.

Figure 10:
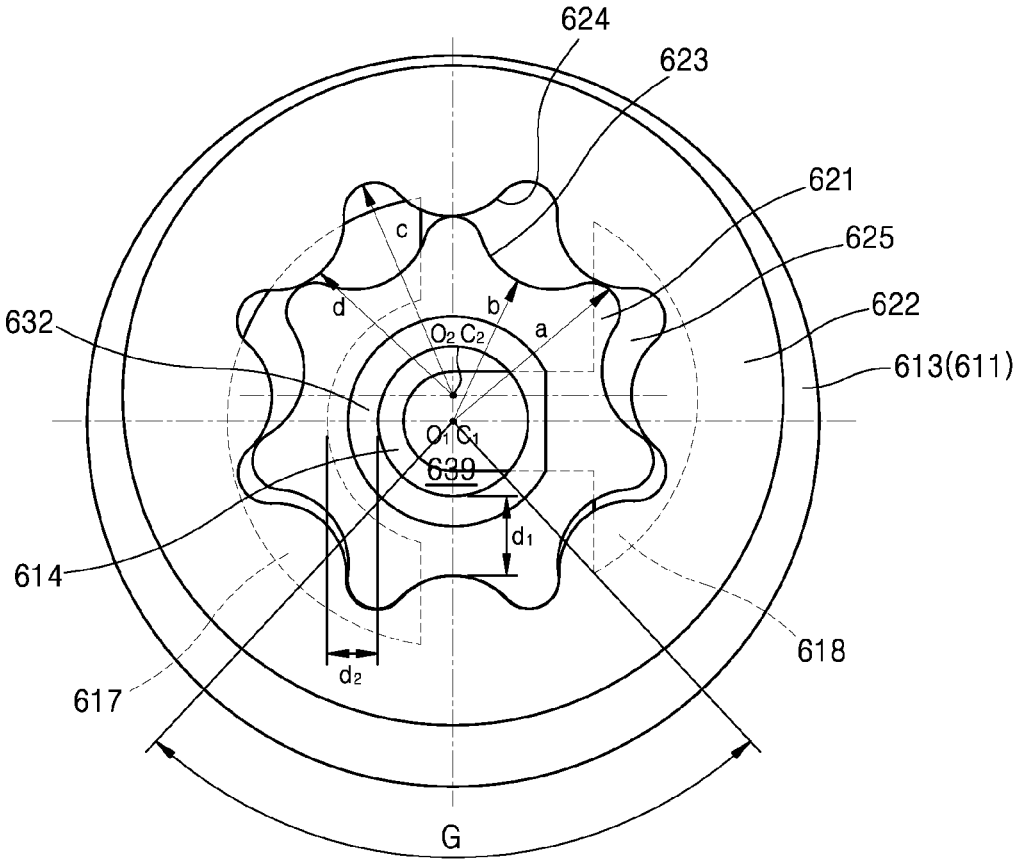
FIG. 10 is a cross sectional view taken along line II-II in FIG. 6.
Figure 11:
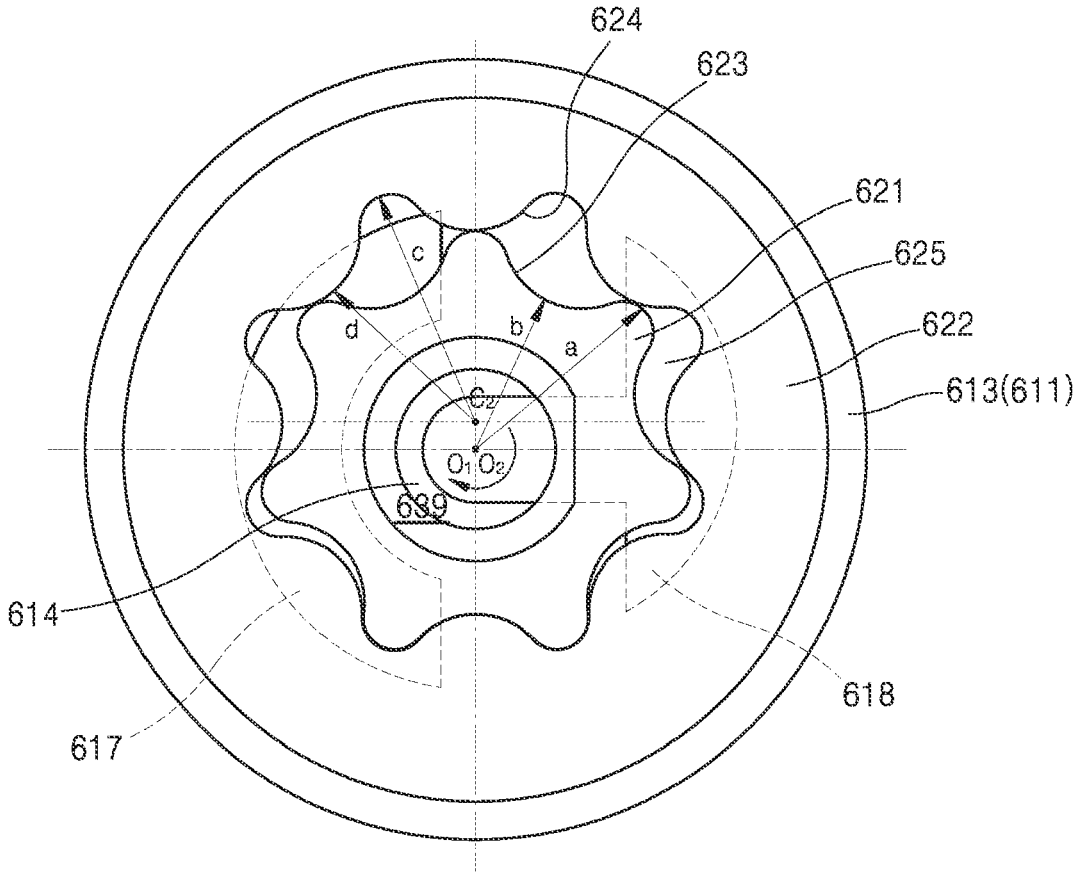
FIG. 11 is a cross sectional view of another implementation of a lubricant supply device of FIG. 10.

Referring to FIGS. 10 and 11, the oil inlet 617 penetrates through an arc-shaped cross section at a position deviated from the center of the first fixer 611. The oil chamber 618 has an arc-shaped form within a range not overlapping with the oil inlet 617 and is a groove shape including the center of the first fixer 611. The oil chamber 618 may be similar to a substantial "T" shape.

A first rotator 621 and a second rotator 622 are accommodated in an accommodation space 615. The first rotator 621 is accommodated inside the second rotator 622. That is, the second rotator 622 is arranged in a form of surrounding the perimeter of the first rotator 621. A plurality of first teeth 623 are continuously provided along the circumferential direction on an outer circumferential surface of the first rotator 621 and a plurality of second teeth 624 are continuously provided along the circumferential direction on an inner circumferential surface of the second rotator 622 that faces the outer circumferential surface of the first rotator 621. A few first teeth 623 are engaged with a few second teeth 624. Accordingly, when the first rotator 621 rotates, the second rotator which is engaged with the first rotator 621 also rotates together.

The first rotator 621 is connected to a lower end, that is, one end of the rotational shaft 50 through the second fixer 612 by a connector 63. The connector 63 is a separate part from the first rotator 621. The connector 63 is connected to the first rotator 621 so as to rotate together with and is connected to the rotational shaft 50 so as to rotate together with. Therefore, when the rotational shaft 50 rotates, it is integrally rotated with the connector 63 and the first rotator 621, and a second rotator 622 rotates by being interlocked therewith.

Figure 8:
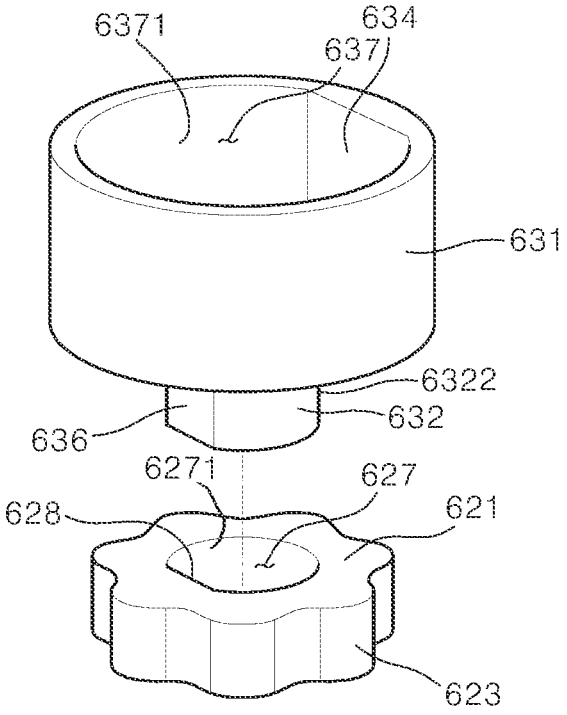
FIG. 8 is a perspective view of a connector and a first rotator of FIG. 7 viewed from the opposite side.

The center of the first rotator 621 is provided with a hole-shaped inner diameter coupler 627 penetrated vertically. The inner diameter coupler 627 has a third idling preventing surface 628 in the form of a D cut form as shown in FIG. 8.

The diameter of the inner diameter coupler 627 may be smaller than or equal to the diameter of a through-hole 616 of the second fixer 612. The cross-sectional area of the inner diameter coupler 627 is included in the cross-sectional area of the through-hole 616 of the second fixer 612. Accordingly, when viewed from the upper portion of FIG. 7, it is possible to see the entire inner diameter coupler 627 through the through-hole 616. That is, the entire inner diameter coupler 627 is exposed to an upper portion through the through-hole 616.

The connector 63 is coupled from the upper portion of the through-hole 616 to the inner diameter coupler 627 through the through-hole 616. The connector 63 includes a rotator mounting member 632 that is inserted into or press-fitted to the inner diameter coupler 627 through the through-hole 616 and a penetrating member 635 in which the outer circumferential surface thereof faces an inner circumferential surface of the through-hole 616 in a state where it extends to an upper portion of the rotator mounting member 632 and penetrates the through-hole 616, an diameter enlarged member 633 that extends radially outwards along an upper surface of the second fixer 612 at the upper portion of the penetrating member 635, and a rotational shaft mounting member 631 in a cylinder form that extends upwards from radial end of the diameter enlarged member 633.

An oil outlet 639 opened vertically is provided at the center of the rotator mounting member 632, the penetrating member 635, the diameter enlarged member 633 and the rotational shaft mounting member 631. The oil outlet 639 communicates with a portion of an oil chamber 618 disposed at the center of the first fixer 611 downwardly and communicates with a lubricant supply flow path 53 formed inside the rotational shaft 50 upwardly.

The rotator mounting member 632 includes an outer circumferential surface 6322 that has the outer diameter corresponding to the inner diameter coupler 627 and has a D cut shape having a fourth idling preventing surface (e.g., an outer contact portion) 636 corresponding to the third idling preventing surface (e.g., a coupler contact surface) 628. Thus, the rotator mounting member 632 can be fitted to the inner diameter coupler 627 of the first rotator 621 through the through-hole 616 of the second fixer 612 from the upper portion, and can be rotated in the rotation direction without a slip phenomenon with the second fixer 612.

The penetrating member 635 includes an outer circumferential surface having a circular profile facing an inner circumferential surface of the through-hole 616. The inner circumferential surface of the through-hole 616 and the outer circumferential surface of the penetrating member 635 are the surfaces that a relative rotation is made to each other and the surfaces in order for oil inside an accommodation space 615 not to leak, and it has a narrow clearance suitable for it.

The diameter enlarged member 633 is a member that increases the diameter of a portion of a connector 63 disposed at an upper portion of a second fixer 612. A lower surface of the diameter enlarged member 633 may face an upper surface of the second fixer 612 and can guide a relative rotation therebetween.

The diameter of the rotational shaft mounting member 631 extending upward from the diameter enlarged member 633 is set larger than that of the through-hole 616. The rotational shaft mounting member 631 may be inserted inside the rotational shaft 50 similarly to a prior structure, but it is possible to be inserted outside the rotational shaft 50 (see FIGS. 6 and 9), that is, rotational shaft 50 is inserted inside the rotational shaft mounting member 631. When the rotational shaft mounting member 631 is inserted outside the rotational shaft 50, it is advantageous in many points than being inserted therein.

A first idling preventing surface 54 in the form of a D cut is provided on an outer circumferential surface of a lower end of the rotational shaft 50 and a second idling preventing surface 54 in the form of a D cut corresponding to the first idling preventing surface 54 is formed on an inner circumferential surface of the rotational shaft mounting member 631. Thus, the rotational shaft mounting member 631 inserted outside the lower portion of the rotational shaft 50 may rotate integrally with the rotational shaft without a slip phenomenon.

If the shaft coupler 626 is inserted inside a lubricant supply flow path 53 of the rotational shaft 50, it is difficult to apply a D cut structure. It is necessary to perform a drilling processing for providing the lubricant supply flow path 53 along the longitudinal direction of the rotational shaft 50. But it is difficult to make the D cut structure while drilling the inner circumferential surface. Further, an outer circumferential surface of a prior shaft coupler 626 and an inner circumferential surface of a lubricant supply flow path 53 were difficult to lower the press-fit tolerance to 0.2 mm or less due to the processing method. This may cause a problem that the shaft coupler 626 and the rotational shaft 50 do not rotate integrally and the slip phenomenon occurs.

On the other hand, when a structure in which the rotational shaft mounting member 631 is inserted outside the outer circumferential surface of the rotational shaft 50 is applied as described in the present disclosure, it is easy to make the D cut structure and it is possible to adjust the press-fit tolerance to 0.103 mm or less. Therefore, the connector 63 and the rotational shaft 50 can be press-fitted to each other accurately and an integral rotation in which the slip does not occur is possible.

Figure 1:
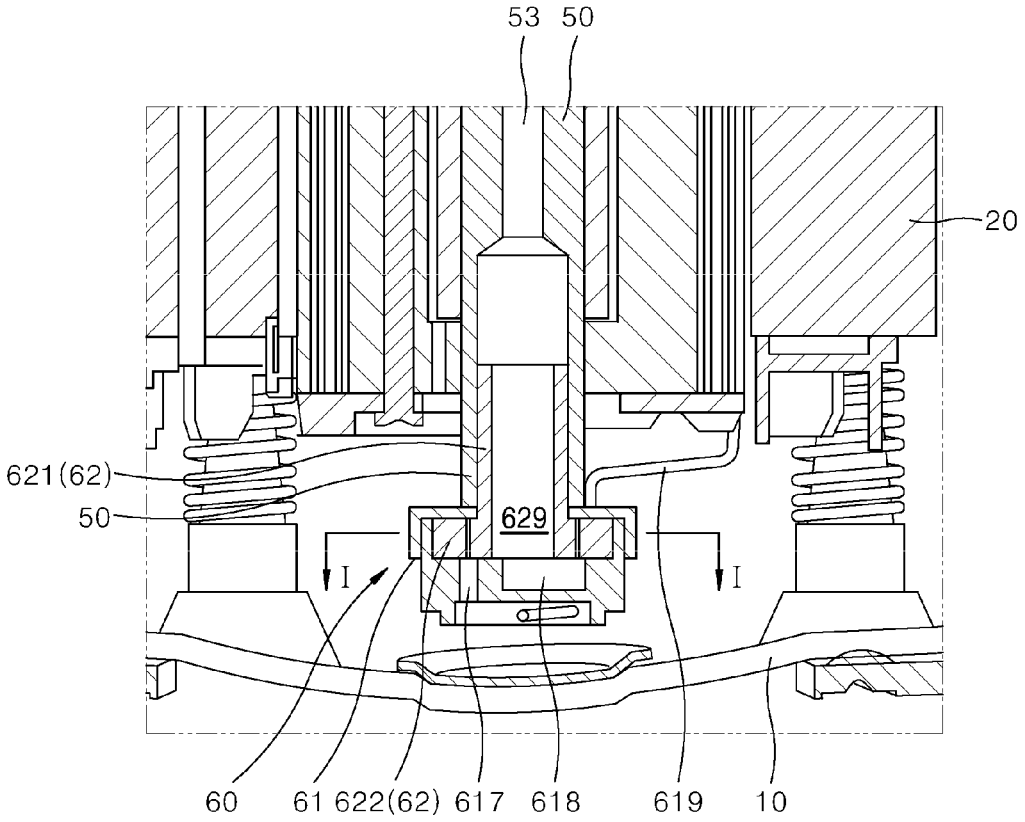
FIG. 1 Prior Art
FIG. 1 is a side cross sectional view of a lubricant supplier applied to a reciprocating compressor.
Figure 2:
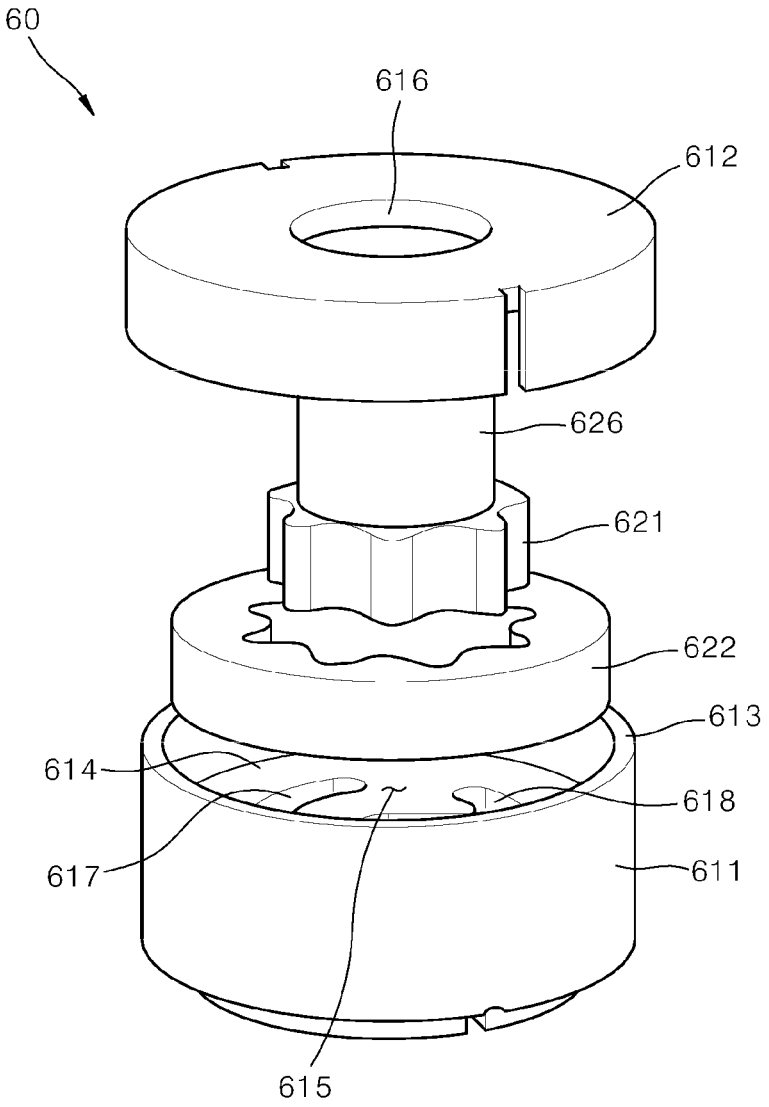
FIG. 2 Prior Art
FIG. 2 is an exploded perspective view of a lubricant supplier of FIG. 1.
Figure 3:
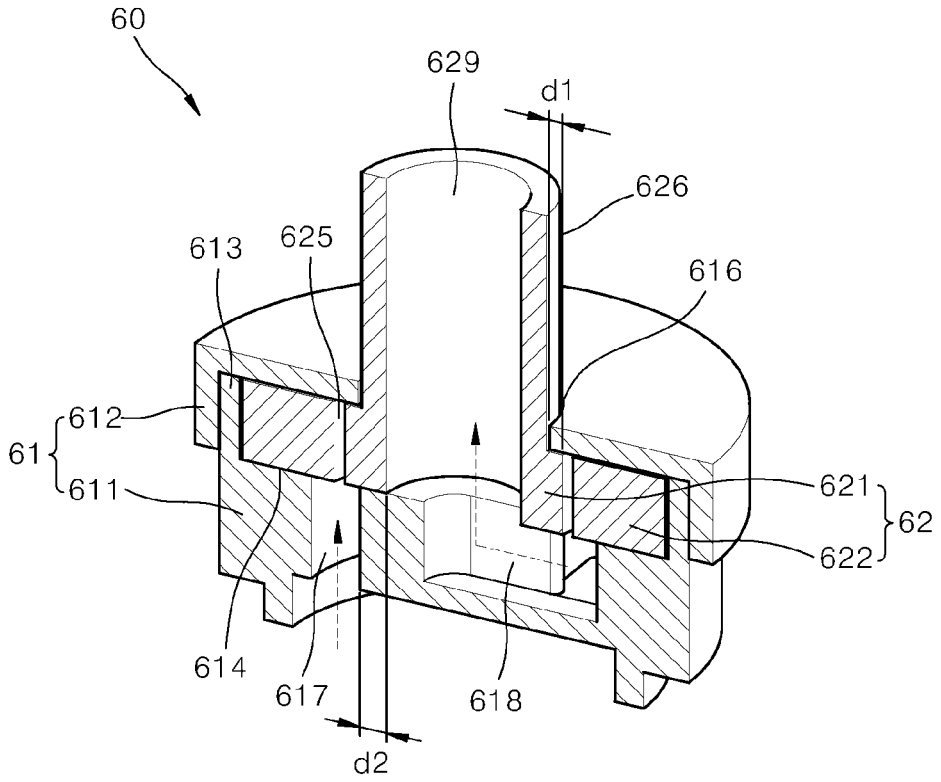
FIG. 3 Prior Art
FIG. 3 is a cross-sectional perspective view showing an assembled state of a lubricant supplier of FIG. 2.
Figure 4:
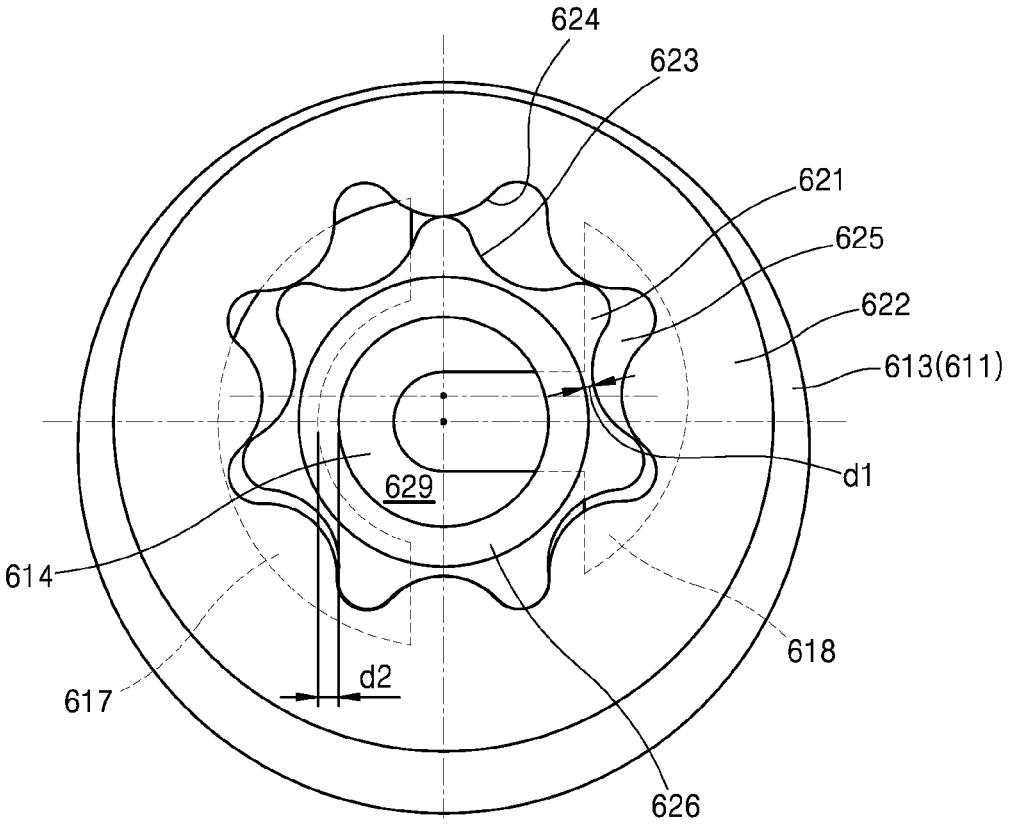
FIG. 4 Prior Art
FIG. 4 is a cross-sectional view taken along line I-I in FIG. 1.

Further, as described above, when a structure in which the first rotator 621 and the connector 63 are made as a separate part and mounted is adopted, as compared with a prior structure (FIGS. 1 to 3), it is possible to set the size of the through-hole 616 to be much smaller than the cross sectional area of the lubricant supply flow path 53. Thus, since it is possible to set the distance d1 between the outer circumferential surface of the first rotator 621 and the inner circumferential surface of the through-hole 616 to be large, a phenomenon in which the oil in the rotator space 625 adjacent to the outer circumferential surface of the first rotator 621 leaks to the inner circumferential surface of the through-hole 616 can be minimized.

Further, unlike the prior structure (FIGS. 1 to 3) in which the diameter of the shaft coupler 626 cannot be varied vertically for the assembly with the second fixer 612, according to the present disclosure, since it is possible to make the diameter of the inner circumferential surface of the rotator mounting member 632 smaller than that of the inner circumferential surface of the rotational shaft mounting member 631, it is possible to increase the distance d2 of the inner circumferential surface of the oil outlet 639 and the oil inlet 617 so that the oil does not leak.

Since it is not required to increase the sizes of the first rotator or the second rotator in securing the distances d1 and d2, it is possible to make the lubricant supply device compact, and it is possible to minimize the power consumption of the rotational shaft in driving the rotator of the lubricant supply device.

When a rotational shaft 50 rotates, a connector 63 and a first rotator 621 rotate together. A second rotator 622 installed to receive a rotational force with regard to the first rotator 621 also rotates.

An outer circumferential surface of the second rotator 622 accommodated in the accommodation space 615 faces an inner circumferential surface of a side wall 613 of the first fixer 611 and a rotation of the second rotator 622 is guided by the inner circumferential surface of a side wall 613.

The first rotator 621 and the second rotator 622 accommodated in the accommodation space 615 is supported by an upper surface of the bottom 614 of the first fixer 611, and is supported by a lower surface of the second fixer 612.

As such, the second rotator 622 is installed in a fixer 61 so as to be rotatable about a rotational center O2 thereof.

The first rotator 621 is also rotatably installed in the fixer 61. Since the first rotator 621 rotates with the rotational shaft 50, the rotational center O1 of the first rotator 621 coincides with the rotational center of the rotational shaft 50.

An oil outlet 639 penetrating vertically is formed inside a connector 63 which is axially coupled to the first rotator 621. The oil outlet 639 communicates with a lubricant supply flow path 53 of the rotational shaft 50 upward and communicates with the oil chamber 618 downward. The lubricant supply flow path 53 is not overlapped with an oil inlet 617. Thus, oil outside a first fixer 611 may be supplied to a lubricant supply flow path 53 sequentially through an oil inlet 617, an accommodation space 615, an oil chamber 618, and an oil outlet 639.

The first rotator 621 and the second rotator 622 rotate in a state of being accommodated in the accommodation space 615.

FIG. 10 shows a lubricant supply device capable of supplying lubricant when a rotator rotates clockwise.

The rotational center O1 of a first rotator 621 coincides with the rotational center of a rotational shaft 50. A first tooth 623 in an outwardly protruding shape is formed on an outer circumferential portion accommodated in the accommodation space in the first rotator 621. The center C1 of the first teeth 623 provided on an outer circumferential surface of the first rotator 621 coincides with the rotational center O1 of the first rotator 621. In other words, a plurality of first teeth 623 is formed radially with regard to the rotational center of the first rotator 621. Accordingly, the first tooth 623 rotates about the rotational center O1 of the first rotator. In the implementation, a structure in which seven first teeth 623 are provided will be illustrated.

The rotational center O2 of the second rotator 622 is offset in a position eccentric from the rotational center O1 of the first rotator 621 and arranged. A second tooth 624 in an inwardly protruding shape is formed on the inner diameter of the second rotator 622 that surrounds the first rotator 621. A plurality of second teeth 624 is formed radially with regard to the center C2 thereof. The number of second teeth is larger than the number of first teeth. As one example, a structure in which eight second teeth 624 are provided may be illustrated. The center C2 of the second teeth 624 provided on the inner circumferential surface of the second rotator 622 coincides with the rotational center O2 of the second rotator 622. Accordingly, the second tooth 624 rotates about the rotational center O2 of the second rotator.

Two teeth 623 and 624 may be made of a shape corresponding to each other and can be tooth-engaged. The profile of the teeth may be a trocoide shape.

When the first rotator 621 rotates as the rotational shaft 50 rotates, rotational force of the first rotator 621 is transmitted to the second rotator 622 through the first tooth 623 and the second tooth 624.

The first tooth and the second tooth are engaged along the circumferential direction in a certain section part but are not engaged in the other section part. In other words, in a section indicated by a substantial G shape in FIG. 10, the first tooth is engaged with the second tooth to transmit the rotational force of the first rotator to the second rotator, and they are not engaged with each other or incompletely engaged in a section other than the above to form a rotator space 625.

Since the center C2 of the second tooth 624 coincides with the center O2 of the second rotator 622, the second tooth 624 rotates in place while pivoting about the center of the rotator 621. That is, the first tooth 623 rotates about its center C1 and the second tooth 624 also rotates about its center C2.

Therefore, the rotator space 625 also maintains its position without rotation. When a rotator 62 rotates clockwise, the rotator space 625 is gradually narrowed from an oil inlet 617 toward an oil chamber 618 while two teeth 623 and 624 rotate.

Therefore, oil that is trapped in the rotator space 625 and moves with the tooth is pressurized by a gradually narrowing space to be pushed into the oil chamber 618, and the oil pushed into the oil chamber 618 moves upwards through an oil outlet 639.

According to such a structure, since the oil trapped in the gradually narrowing space is extruded and supplied, a supply of the lubricant may be made very well. On the other hand, in FIG. 10, when the rotator 62 rotates counterclockwise, an oil supply is not made.

On the other hand, a structure and an operation of the lubricant supply device in which the oil supply can be made even when rotating clockwise as well as counterclockwise will be described with reference to FIG. 11.

Referring to FIG. 11, the rotational center O1 of the first rotator 621 and the rotational center O2 of the second rotator 622 coincide with each other.

A first tooth 623 in an outwardly protruding shape is formed at an outer diameter portion of the first rotator 621 accommodated in the accommodation space. A plurality of first teeth 623 is formed radially about the rotational center of the first rotator 621. Accordingly, the first tooth 623 rotates about the rotational center O1 of the first rotator. As one example, a structure in which seven first teeth 623 is provided will be illustrated.

A second tooth 624 in the inwardly protruding shape is formed on the inner diameter portion of the second rotator 622 surrounding the first rotator 621. A plurality of second teeth 624 may be formed radially with regard to the center C2 thereof. The number of second teeth may be larger than that of the first teeth. As one example, a structure in which eight second teeth 624 are provided will be illustrated.

Two teeth 623 and 624 have a shape corresponding to each other and can be tooth-engaged with each other. The profile of the teeth may be a trocoide shape.

The radius b of a groove of the first tooth 623 is smaller than the radius d of a protrusion of the second tooth 624. Further, the radius a of a protrusion of the first tooth 623 is larger than the radius d of the protrusion of the second tooth 624 and smaller than the radius c of a groove of the second tooth 624.

According to another implementation of the present disclosure shown in FIG. 11, the center C2 of the second tooth 624 is eccentric with regard to the center O2 of the second rotator 622. The eccentric distance is equal to or slightly smaller than the difference between the radius c of a protrusion of the second tooth 624 and the radius a of the protrusion of the first tooth 623. Therefore, a rotator space 625 exists between the first tooth 623 and the second tooth 624.

The volume of the rotator space 625 is distributed more in adjacent to the center C2 of the second tooth with regard to the rotational centers O1 and O2. Conversely, the first tooth 623 and the second tooth 624 are mutually engaged on the side far from the center C2 of the second tooth based on the rotational centers O1 and O2.

Since two rotational centers O1 and O2 coincide with each other, when a rotational shaft 50 rotates, the first rotator 621 and the second rotator 622 concentrically rotate together. However, since the center C2 of the second tooth 624 is eccentric from the center O2 of the second rotator 622, the center C2 of the second tooth 624 is revolved about the rotational center O2 of the second rotator 622. Thus, the rotator space 625 is also revolved about the rotational center O2 of the second rotator 622.

According to such a rotation motion, the first rotator 621 and the second rotator 622 rotate at the same angular velocity to each other while a position in which the first tooth 623 and the second tooth 624 are not engaged with each other is not changed. This is distinguished from the fact that the angular velocity of the first rotator 621 is faster than that of the second rotator 622 in the implementation of FIG. 10.

An oil inlet 617 of a first fixer 611 is in a position overlapped with a revolving orbit of the rotator space 625. Thus, when a rotator 62 rotates in a state in which the oil inlet 617 and the rotator space 625 are overlapped with each other, the oil that has flowed in the rotator space 625 through the oil inlet 617 revolves together in a state of being tapped in the rotator space 625.

The oil chamber 618 is also in a position being overlapped with a revolving orbit of the rotator space 625. Therefore, the oil moved through the accommodation space 615 in a state of being trapped in the rotator space 625 falls to the oil chamber 618 by gravity. The oil falling in the oil chamber 618 has a linear velocity of the rotator space 625 and is forcedly flowed in the oil chamber 618 so that oil filled in the oil chamber 618 is pushed up and go up to an upper portion through an oil outlet 629.

In FIG. 11, a form in which a rotator 62 rotates clockwise is shown as an arrow. However, according to the above-described principle, even if the rotator 62 rotates counter-clockwise, a lubricant supply action occurs to the same extent as rotating clockwise. Therefore, a lubricant supply device according to the present disclosure shown in FIG. 11 can supply lubricant regardless of a rotation direction of a rotational shaft.

When the lubricant supply device of the present disclosure is applied to a reciprocating compressor, both a compression operation and a lubricant supply operation are made well even if the rotational shaft 50 rotates in any direction. Therefore, the maximum efficiency speed range when a motor rotates in the forward direction and rotates in the reverse direction can be designed differently, so that an efficiency of a compressor can be increased at a wider operation speed of a compressor.

Figure 9:
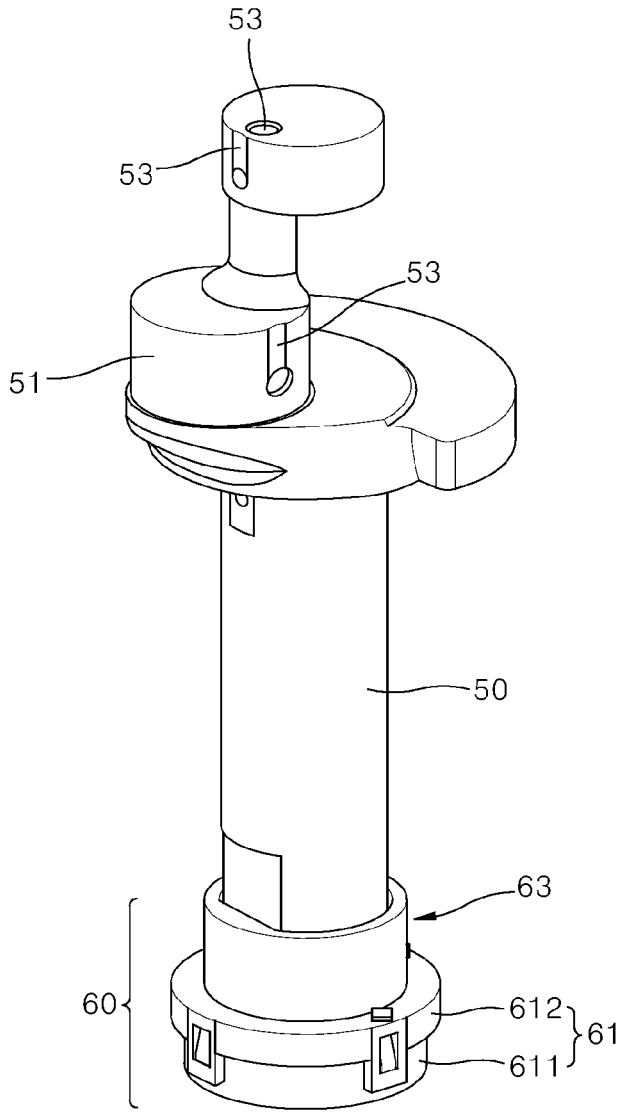
FIG. 9 is a perspective view showing a state in which a lubricant supply device of FIGS. 5 and 6 is installed at one end of the rotational shaft.

FIG. 9 shows that a lubricant supply flow path 53 is formed on a rotational shaft 50, which is expected to rotate in the bi-direction. The lubricant supply flow path 53 is provided at a lower portion of the rotational shaft 50 at an inner diameter portion, which is branched and extends upward. That is, a part of the flow path 53 extends through an inner portion of the rotational shaft 50 as shown in FIG. 5, and the part of the flow path 53 extends in a groove at an outer diameter portion of the rotational shaft 50.

In FIG. 9, a groove-shaped lubricant supply flow path 53 formed in an outer diameter of the rotational shaft 50 or a crank pin 51 is formed in a linear shape which is a direction parallel to the longitudinal direction of a rotational shaft. This is a structure that allows oil to move upwards even if it rotates in any direction.

According to the implementation of FIG. 11, a structure, in which the rotator 62 is divided into a first rotator and a second rotator and the divided first rotator and second rotator are mounted, is illustrated. However, according to the present disclosure, it is possible to manufacture the rotator 62 as a single part, and form a rotator space 625 at a position radially spaced part from the rotational center and expect the same operation even if a revolving orbit of the rotator space 625, the oil inlet 617, and the oil chamber 618 are overlapped.

However, the above-described implementation is more advantageous in that a common use of a part with a lubricant supply device of FIG. 10 in which a lubricant can be supplied at the time of a uni-directional rotation.

The geometrical difference between FIGS. 10 and 11 is only the positional difference of the rotational center O2 of the second rotator 622. Due to this position change of the center O2, the lubricant supply device may be a uni-directional supply device or a bi-directional supply device.

Therefore, when the above configuration is included, the common use of the part of the uni-directional supply device and the bi-directional supply device of the lubricant is possible. For example, the components of a first fixer and a second rotator of two supplying devices are different from each other, and the components of a second fixer and a first rotator can be commonly used.

While the present disclosure has been described with reference to the exemplary drawings thereof, the present disclosure is not limited to the disclosed exemplary implementations and drawings disclosed in the present specification, it will be apparent to one skilled in the art in the scope of the technical spirit of the present disclosure that various modifications can be made. In addition, although the working effects provided by a certain configuration of the present disclosure are not clearly described in description of the exemplary implementation of the present disclosure, it should be noted that expectable effects of the corresponding configuration should be acknowledged.

What is claimed is:

1. A lubricant supply device that is configured to be installed at an end of a rotational shaft and that is configured to supply lubricant to a lubricant supply flow path defined along a longitudinal direction of the rotational shaft, the lubricant supply device comprising:

a fixer that defines an oil inlet, an accommodation space that communicates with the oil inlet, and an oil chamber that is spaced apart from the oil inlet, and that communicates with the oil inlet via the accommodation space, the fixer comprising a fixer cover that defines a through-hole at a center of the fixer cover and that covers an upper portion of the accommodation space of the fixer; and a rotator that is accommodated in the accommodation space of the fixer, that is coupled to the rotational shaft, and that is configured to rotate together with the rotational shaft, the rotator defining a rotator space that is positioned radially outward of a rotational center of the rotator and that faces the oil inlet and the oil chamber;

wherein the rotator comprises:

an inner diameter coupler located at the rotational center of the rotator, and a connector that connects the inner diameter coupler to the rotational shaft and that defines an oil outlet connected to the oil chamber and the lubricant supply flow path, the connector comprising:

a rotator mounting member that is inserted into and fixed to the inner diameter coupler, a penetrating member that extends axially from the rotator mounting member and that penetrates the through-hole of the fixer cover, a diameter extension member that extends radially outward from the penetrating member and that is located at an upper portion of the fixer cover, and a rotational shaft mounting member that extends axially from the diameter extension member and that is fastened to the rotational shaft, and wherein the rotator is configured to, based on rotating relative to the fixer, (i) cause oil in the rotator space received through the oil inlet to be supplied to the oil chamber and (ii) cause oil in the oil chamber to be supplied to the lubricant supply flow path through the oil outlet.

2. The lubricant supply device of claim 1, wherein a cross-sectional area of the inner diameter coupler defined inside an outer circumferential surface of the inner diameter coupler is disposed within in a cross-sectional area of the penetrating member defined inside an outer circumferential surface of the penetrating member.

3. The lubricant supply device of claim 1, wherein an inner diameter of the inner diameter coupler is less than or equal to an outer diameter of the penetrating member.

4. The lubricant supply device of claim 1, wherein an outer diameter of the penetrating member is less than an outer diameter of the rotational shaft mounting member.

5. The lubricant supply device of claim 1, wherein the rotational shaft mounting member defines a shaft coupling space configured to receive the end of the rotational shaft at an inside of the rotational shaft mounting member.

6. The lubricant supply device of claim 5, wherein the rotational shaft mounting member has an inner circumferential surface comprising an inner contact portion that contacts a shaft contact surface defined at an outer circumferential surface of the end of the rotational shaft.

7. The lubricant supply device of claim 1, wherein the rotational shaft mounting member has an outer circumferential surface comprising an outer contact portion that contacts a coupler contact surface defined at an inner circumferential surface of the inner diameter coupler.

8. The lubricant supply device of claim 1, wherein the fixer further comprises a fixer body that defines the oil inlet, the accommodation space that accommodates the rotator, and the oil chamber, and wherein the fixer cover covers the accommodation space in a state in which the rotator is accommodated in the accommodation space.

9. The lubricant supply device of claim 1, wherein the rotator further comprises:

a first rotator having a center region that defines the inner diameter coupler, the first rotator comprising a first tooth that is disposed at an outer circumference of the first rotator; and a second rotator accommodated in the accommodation space of the fixer, the second rotator comprising a second tooth that is disposed at an inner circumference of the second rotator, that surrounds the first tooth, and that is configured to engage with the first tooth, and wherein at least a portion of the first tooth is spaced apart from the second tooth to define the rotator space between the first tooth and the second tooth.

10. The lubricant supply device of claim 9, wherein a first rotational center of the first rotator is disposed at a second rotational center of the second rotator, and wherein a tooth center of the second tooth is disposed eccentrically from the first rotational center of the first rotator.

11. The lubricant supply device of claim 10, wherein the first tooth and the second tooth have tooth profiles that correspond to each other and that are configured to engage with each other, wherein the first tooth comprises a first plurality of teeth, and the second tooth comprises a second plurality of teeth, and wherein a number of the second plurality of teeth is greater than a number of the first plurality of teeth.

12. The lubricant supply device of claim 11, wherein the first tooth defines a first groove radius based on a plurality of grooves of the first plurality of teeth, and a first protrusion radius based on a plurality of protrusions of the first plurality of teeth, wherein the second tooth defines a second groove radius based on a plurality of grooves of the second plurality of teeth, and a second protrusion radius based on a plurality of protrusions of the second plurality of teeth, wherein the first groove radius is smaller than the second protrusion radius, and wherein the first protrusion radius is larger than the second protrusion radius and smaller than the second groove radius.

13. The lubricant supply device of claim 12, wherein a distance between the tooth center of the second tooth and the first rotational center of the first rotator is less than or equal to a difference between the second groove radius and the first protrusion radius.

14. A compressor, comprising:

a rotational shaft that defines a lubricant supply flow path along a longitudinal direction of the rotational shaft;

a frame comprising a rotation supporter configured to support rotation of the rotational shaft;

a motor that is located at the rotational shaft and the frame and that is configured to rotate the rotational shaft in a first direction and in a second direction with respect to the frame, the second direction being opposite to the first direction;

a housing comprising a lower portion configured to store lubricant and an upper portion that accommodates the frame; and a lubricant supply device that is installed at an end of the rotational shaft and that is configured to supply the lubricant stored in the lower portion of the housing to the lubricant supply flow path, at least a portion of the lubricant supply device being disposed in the lubricant stored in the lower portion of the housing, wherein the lubricant supply device comprises:

a fixer that defines an oil inlet, an accommodation space that communicates with the oil inlet, and an oil chamber that is spaced apart from the oil inlet and that communicates with the oil inlet via the accommodation space, the fixer comprising a fixer cover that defines a through-hole at a center of the fixer cover and that covers an upper portion of the accommodation space of the fixer, and a rotator that is accommodated in the accommodation space of the fixer, that is coupled to the rotational shaft, and that is configured to rotate together with the rotational shaft, the rotator defining a rotator space that is positioned radially outward of a rotational center of the rotator and that faces the oil inlet and the oil chamber;

wherein the rotator comprises:

an inner diameter coupler located at the rotational center of the rotator, and a connector that connects the inner diameter coupler to the rotational shaft and that defines an oil outlet connected to the oil chamber and the lubricant supply flow path, and wherein the rotator is configured to, based on rotating relative to the fixer, (i) cause oil in the rotator space received through the oil inlet to be supplied to the oil chamber and (ii) cause oil in the oil chamber to be supplied to the lubricant supply flow path through the oil outlet.

15. The compressor of claim 14, wherein the connector comprises:

a rotator mounting member that is inserted into and fixed to the inner diameter coupler;

a penetrating member that extends axially from the rotator mounting member and that penetrates the through-hole of the fixer cover;

a diameter extension member that extends radially outward from the penetrating member and that is located at an upper portion of the fixer cover; and a rotational shaft mounting member that extends axially from the diameter extension member and that is fastened to the rotational shaft.

16. The compressor of claim 15, wherein a cross-sectional area of the inner diameter coupler defined inside an outer circumferential surface of the inner diameter coupler is disposed within in a cross-sectional area of the penetrating member defined inside an outer circumferential surface of the penetrating member.

17. The compressor of claim 15, wherein an inner diameter of the inner diameter coupler is less than or equal to an inner diameter of the penetrating member.

18. The compressor of claim 15, wherein an outer diameter of the penetrating member is less than an outer diameter of the rotational shaft mounting member.

19. The compressor of claim 15, wherein the rotational shaft mounting member defines a shaft coupling space configured to receive the end of the rotational shaft at an inside of the rotational shaft mounting member.

20. The compressor of claim 14, wherein the fixer further comprises a fixer body that defines the oil inlet, the accommodation space that accommodates the rotator, and the oil chamber, and wherein the fixer cover covers the accommodation space in a state in which the rotator is accommodated in the accommodation space.

* * * * *